United States Patent [19]

Calhoun et al.

[11] Patent Number: 4,930,266

[45] Date of Patent: Jun. 5, 1990

[54] ABRASIVE SHEETING HAVING INDIVIDUALLY POSITIONED ABRASIVE GRANULES

[75] Inventors: Clyde D. Calhoun, Grant Township, Washington County, Minn.; George D. Foss, Amery, Wis.; Maurice J. Fleming, Cottage Grove; Wesley J. Bruxvoort, Woodbury, both of Minn.

[73] Assignee: Minnesota Mining and Manufacturing Company, St. Paul, Minn.

[21] Appl. No.: 355,893

[22] Filed: May 19, 1989

Related U.S. Application Data

[63] Continuation of Ser. No. 160,776, Feb. 26, 1988, abandoned.

[51] Int. Cl.[5] ..... B24D 3/00

[52] U.S. Cl. ..... 51/293; 51/295

[58] Field of Search ..... 51/293, 295

[56] References Cited

U.S. PATENT DOCUMENTS

| | | | |
|---|---|---|---|
| Re. 29,808 | 10/1978 | Wagner | 51/401 |
| 794,495 | 7/1905 | Gorton | 51/295 |
| 1,657,784 | 1/1928 | Bergstrom | 51/295 |
| 3,906,684 | 9/1975 | Marshall et al. | 51/298 |
| 3,916,584 | 11/1975 | Howard et al. | 51/308 |
| 4,038,047 | 7/1977 | Haywood | 51/295 |
| 4,111,667 | 9/1978 | Adams | 51/295 |
| 4,112,631 | 9/1978 | Howard | 51/295 |
| 4,132,533 | 1/1979 | Löhmer et al. | 51/295 |
| 4,240,807 | 12/1980 | Kronzer | 51/298 |
| 4,255,164 | 3/1981 | Butske et al. | 51/295 |
| 4,311,489 | 1/1982 | Kressner | 51/298 |
| 4,317,660 | 3/1982 | Kramis et al. | 51/295 |
| 4,536,195 | 8/1985 | Ishikawa | 51/293 |
| 4,541,842 | 9/1985 | Rostoker | 51/296 |
| 4,543,106 | 9/1985 | Parakh | 51/295 |

*Primary Examiner*—A. Lionel Clingman
*Assistant Examiner*—Willie J. Thompson
*Attorney, Agent, or Firm*—Donald M. Sell; Walter N. Kirn; Richard Francis

[57] ABSTRACT

Abrasive sheeting can produce fine finishes at surprisingly high cutting rates when its abrasive granules are individually positioned in a predetermined pattern, with an uncoated portion of virtually every granule protruding from the surface of the binder layer. Each of the abrasive granules preferably is a spherical composite of a large number of abrasive grains in a binder. For example, abrasive grains having a mean dimension of about 4 μm can be bonded together to form spherical abrasive granules of virtually identical diameters, preferably within a range of from 25 to 100 μm.

21 Claims, 3 Drawing Sheets

ABRASIVE SHEETING HAVING INDIVIDUALLY POSITIONED ABRASIVE GRANULES

This is a continuation of application Ser. No. 07/160,776 filed Feb. 26, 1988, now abandoned.

BACKGROUND OF THE INVENTION

1. Field of the Invention

The invention concerns abrasive sheeting or coated abrasives of the type having a backing which usually is flexible and carries abrasive grains or granules embedded in a binder layer and usually is flexible.

2. Description of the Related Art

At least as early as 1905, as taught in U.S. Pat. No. 794,495 (Gorton), it was discovered that unbroken "abrading surfaces soon become clogged and gummed by the fine grit and minute particles worn from the abrading surface and from the metal-work (or other work) being held to the abrading-surface" and that these materials can be carried away more effectively by the abrasive grit in a dot pattern. In U.S. Pat. No. 1,657,784 (Bergstrom), a dot pattern is obtained by applying a binder to a backing, applying abrasive grains or granules to the binder, and then scraping off portions of the binder and adhered abrasive granules. More commonly, an adhesive is applied in a dot pattern so that the abrasive granules adhere only in that pattern. In U.S. Pat. No. 4,317,660 (Kramis et al.), the adhesive dot pattern is obtained by applying the adhesive through stencil holes. After attracting a large number of abrasive granules to each dot, the abrasive granules are covered with a size coat.

In abrasive sheeting that has appeared on the market with such a dot pattern, there is a heap or a pile of abrasive granules at each dot, and that heap of granules is covered with a size coat. Because the height of each heap is more or less random, the individual heaps and the individual granules of each heap are loaded differently and hence produce uneven cutting. The size coat interferes with the cutting action of the abrasive granules and also results in uneven cutting due to variations in the extent to which the size coat covers the abrasive granules.

Uneven cutting of prior abrasive sheetings also emanates from irregular sizes and shapes of their abrasive granules. This effect has been minimized by using spherical granules of equal size. Another type of spherical abrasive granule consists of a large number of abrasive grains in either an organic or inorganic matrix. Because of their uniformity, such composite granules renew themselves as they wear away, thus maintaining relatively uniform abrasive cutting action for longer periods of time than has been possible when using abrasive sheeting coated with irregular abrasive granules. Such composite abrasive granules are disclosed in U.S. Pat. Nos. 3,916,584 (Howard et al.); No. 4,112,631 (Howard); and No. 4,541,842 (Rostoker). U.S. Pat. No. Re. 29,808 (Wagner) shows hollow balls consisting of abrasive grains bonded onto the outer surface of a friable matrix. Even though FIG. 1 of the Wagner patent shows those spheres uniformly positioned in a binder layer, the patent says that the hollow balls "are mixed with a bonding material and brought into the shape of the grinding body, after which the bonding material is allowed to harden out, and during the production of an abrasive belt the hollow bodies are bonded in the usual manner to a base material" (col. 6, lines 43–48). In Example 1, ready-prepared abrasive grain balls are uniformly strewn onto a layer of resin on a cotton twill fabric.

Even when prior abrasive sheetings employ composite spherical granules of equal size, sheetings made at one time tend to have different cutting rates than do those made at other times due to variables in their manufacture. Accordingly, when prior abrasive sheetings have been used under numerical or robotic control, it has been necessary to test the cutting rate of each jumbo roll before putting it to use.

Abrasive sheeting ordinarily is manufactured in great lengths that are wound into rolls for storage and shipment. Eventually, the sheeting is die-cut into desired sizes and shapes. For example, it may be cut to form daisy pads that are used to polish lenses. In doing so, the die contacts the abrasive particles which cause its cutting edge to become dull and to require resharpening within a short period of time.

1. Other Prior Art

Abrasive tools are often made by handsetting abrasive granules such as diamonds, but such granules are quite large. It is believed that handsetting has never been employed in abrasive sheeting that has appeared in the market.

U.S. Pat No. 4,536,195 (Ishikawa) concerns a method of making grinding stones, the abrasive grains of which are distributed in a controlled manner so that the load working on each grain is even, making the stone more efficient and of longer life. In a first variation of the Ishikawa method, an electrically conductive pattern is formed on a resinous binder sheet which is then immersed into an electroplating path containing metallic ions mixed with abrasive grains that are attracted to the pattern. The electrically conductive pattern may be formed by photoetching or printing techniques. A number of the abrasive-bearing sheets are placed in layers and molded into a grinding stone by warm or hot pressure molding. Another variation is the same as the first except that the sheet is metallic and a surface is masked so that the abrasive grains are attracted only to the unmasked areas. An example of distribution of abrasive grains on the surface of a grinding stone is shown in FIG. 15 wherein the grains are located in rows and uniformly spaced from adjacent grains.

SUMMARY OF THE INVENTION

The invention provides abrasive sheeting or coated abrasive that can produce finer finishes at faster cutting rates than could be attained in the prior art. Furthermore, the novel abrasive sheeting is believed to provide a more predictable cutting rate, thus minimizing the need to test its cutting rate before using it in robotic or numerically controlled machines.

Briefly, the abrasive sheeting of the invention has a backing carrying a binder in which abrasive granules are strongly bonded and lie substantially in a plane and at a predetermined lateral spacing. The granules should be of substantially equal size, i.e., the mean dimension of 90% of the granules should differ by less than 2:1. Each of the abrasive granules should pass a screen with 300 μm openings, because substantially larger granules would not provide the fine finishes desired in uses for which the novel abrasive sheeting is intended.

The granules preferably are in a predetermined pattern (or patterns when using granules of differing sizes or types) that provides spaces between the granules of sufficient width to carry off detritus. In a preferred pattern, single granules are uniformly spaced and aligned in rows extending both longitudinally and transversely (i.e., in the X and Y directions). In another preferred pattern, abrasive sheeting having circular rows of uniformly spaced granules can be cut into discs, the centers of which are concentric with the circular rows.

Preferably the abrasive granules are equiax, and the diameter of substantially every granule is within 10% of the mean diameter so that the granules protrude from the surface of the binder layer to substantially the same extent and so can be loaded equally upon contacting a workpiece, thus providing an extraordinarily uniform finish. By "equiax" is meant that each granule has approximately the same thickness in every direction. An equiax granule can be considered to have a diameter, whether or not it is spherical.

The abrasive granules can have various populations at various areas of the novel abrasive sheeting in order to remove material at differing rates from selected faces of a workpiece. In one technique for determining the populations required to accomplish this, the wear of abrasive sheets of uniform density is studied, and the novel abrasive sheeting is made to have increased granule population at areas showing the most wear. The predetermined granule pattern also can be selected to leave the novel abrasive sheeting free from abrasive granules in areas to be die-cut, thus allowing the die to remain sharp much longer than has heretofore been possible. This also minimizes waste.

The invention also concerns a novel method of making abrasive sheeting by the sequential steps of (1) attracting small abrasive granules only to dots in a predetermined pattern on a carrier, (2) while advancing a backing that carries a tacky binder layer in synchronism with said carrier, transferring the attracted granules into the binder layer in said pattern, and (3) rendering the binder nontacky.

When the carrier is at the surface of a rotating cylinder this 3-step method can produce abrasive sheeting of almost unlimited length which can be wound up in roll form for convenient storage and shipment. In such a roll, the predetermined pattern of abrasive granules repeats many times. Such a roll can be converted into a variety of articles such as discs, daisies, sheets, and belts.

When the abrasive granules have irregular shapes, the 3-step method causes the major axis of each granule to lie substantially in a plane parallel to the backing. Hence, when irregular granules are of substantially the same size, they tend to protrude from the binder to substantially the same extent and to abrade uniformly to afford uniform finishes.

Preferably the binder is selected so that subsequent to step (2) is an additional step of softening the binder, usually by being heated, to form a meniscus at each granule, thus enhancing the bonding of each granule to the backing. Doing so should make it unnecessary to overcoat the granules, thus leaving the cutting surface of each granule free from material that could otherwise interfere with its abrasive function. When heat is used to form menisci, the extent to which the abrasive granules protrude from the binder can be controlled by adjusting the time and temperature at which the menisci are formed. When a meniscus is to be formed at each abrasive granule, the pressure applied in step (2) can be very light, just enough to tack the granules to the binder layer.

Instead of, or in addition to, forming a meniscus at each granule, a size coat can be applied over the novel abrasive sheeting to enhance the bonding of the abrasive granules. Usually this is unnecessary, unless the abrasive granules are rather large, e.g., are retained by a screen with 100 μm openings. When the abrasive granules are expensive, e.g., diamonds, a size coat may be desirable to ensure that they are not dislodged and lost.

Although the individual abrasive granules that lie in a predetermined pattern should be of substantially equal size, selected areas of the novel abrasive sheeting can have abrasive granules of one size in one predetermined pattern while other areas have granules of a different size in another predetermined pattern, each to provide a desired rate of cutting and degree of finish at a particular area of a workpiece. For the same reason, the novel abrasive sheeting may employ abrasive granules of two or more different types, each type being individually positioned in a predetermined pattern. In order to make abrasive sheeting having two sizes or two types of abrasive granules, steps (1) and (2) are repeated with the second size or type of granule prior to step (3).

DETAILED DESCRIPTION

Each of the abrasive granules of the novel sheeting preferably is an equiax composite of a large number of abrasive grains in an inorganic or organic binder matrix. For example, abrasive grains having a mean dimension of about 4 μm can be bonded together to form spheres of virtually identical diameters, preferably within a range of from 25 to 100 μm. Because of their uniform diameter, each equiax granule can be positioned to protrude to the same extent from the binder layer. By individually positioning the equiax granules to be spaced equally from adjacent granules, the granules each bear the same load and hence wear at substantially identical rates and tend to continue to be equally effective as long as uncoated portions protrude from the binder layer. Consequently, workpieces continue to be polished uniformly, in contrast to the tendency of prior abrasive sheeting to provide uneven polishing upon becoming worn.

Preferably the thickness of the binder layer of the novel abrasive sheeting is from 25 to 150 μm. Thicknesses above that range may be uneconomical, while thicknesses below that range may not bind the abrasive granules as strongly as desired. When the binder layer is coated from solution or emulsion, it may be difficult to obtain uniform layers much greater than 50 μm.

A carrier that can be used in the above-outlined 3-step process is a printing plate marketed by Toray Industries as "Toray Waterless Plate." It has a flexible sheet of aluminum bearing a layer of photosensitive material covered with a layer of silicone rubber. Upon exposure to light through a half-tone screen, the silicone rubber of a positive-acting plate causes the photosensitive material to bind itself firmly to the silicone rubber in areas where the light strikes, after which the silicone rubber in unexposed areas can be brushed off, leaving silicone rubber dots in the predetermined pattern provided by the light exposure. The printing plate is then wrapped onto a cylinder, and the cylinder is rotated through a fluidized bed of abrasive granules. The granules are attracted to the printing plate only where the silicone rubber remains and not to the ink-receptive areas. Upon moving a binder-carrying backing in synchronism with the rotating printing plate, the granules are picked up by and become embedded into the binder layer in the pattern of the printing plate. That pattern repeats many times when the backing is long.

When a "Toray Waterless Plate" is used in the above-outlined 3-step process and the tacky binder layer would stick to the silicone rubber of the printing plate, a transfer roll can be positioned between the binder layer and the printing plate. The surface of the transfer roll should be selected to cause the abrasive granules to transfer from the silicone rubber of the printing plate, while acting as a release surface in relation to the tacky binder.

For most applications of the novel sheet, the breadth of the dots formed in step (1) of the above 3-step process should be small enough that only one abrasive granule is attracted to each position, but when each dot is large enough to make it fairly certain that there will be a granule at every dot, it can be expected two or possibly three granules will be deposited side by side at a few positions. When only one abrasive granule per dot is desired, each dot preferably is roughly circular and has a diameter within the range of 30 to 90% of the mean dimension of the abrasive granules. When using spherical abrasive granules 80 μm in diameter, good results have been attained with dots 62 μm in diameter. When the diameter of each dot substantially exceeds the diameter of an abrasive granule, a monolayer of several granules may be attracted to each dot.

The use of a printing plate mounted on a cylinder in the above-outlined 3-step process may result in a seam that may produce discontinuities in the pattern of abrasive granules. Abrasive sheeting of the invention, that has no seam in its pattern, can be made by sequentially coating onto a cylinder formulations that provide a cylindrical printing plate, preferably including a silicone rubber layer. Preferred sequential coating formulations are those of U.S. Pat. No. 3,511,178 (Curtin).

If a seam in the pattern is not objectionable, step (1) of the above-outlined 3-step process for making abrasive sheeting of the invention can use a carrier prepared by the steps of (1) coating one face of a sheet of metal foil with rubber and the other face with a photoresist, (2) exposing the photoresist to light in a predetermined pattern, (3) removing areas of the photoresist corresponding to said pattern, and (4) etching away the metal foil in said areas to expose the rubber in said predetermined pattern.

It is also preferred, particularly if the abrasive granules would be attracted to the remaining photoresist, to include after the etching step the step (5) removing the remaining photoresist.

Among classes of binders that can be used in the novel abrasive sheeting are thermoplastic resins such as ethylene/acrylic acid copolymer, polyethylene, and poly(ethylmethylacrylic) acid, which is available from E. I. duPont Company under the trade designation "Surlyn". Another useful class of binders is acrylic pressure-sensitive adhesives which cure to a nontacky state. Also useful are thermosetting binders which have a tacky state such as epoxy resins, phenolics, and polyurethanes.

The backing of the novel abrasive sheeting can be fabric (e.g., woven or non-woven fabric such as paper) which may be saturated with a filled binder material, a polymer film such as that formed of oriented heat-set polypropylene or poly(ethylene terephthalate) which may be first primed, if needed, with a priming material, or any other conventional backing material.

In the novel abrasive sheeting, the addition of a grinding aid over the surface of the abrasive granules may provide improved grinding performance. Grinding aids may also be added to the size coat or as particulate material. The preferred grinding aid is $KBF_4$, although other grinding aids are also believed to be useful. Other useful grinding aides include NaCl, sulfur, $K_2TiF_6$, polyvinyl chloride, polyvinylidene chloride, cryolite and combinations and mixtures thereof. The preferred amount of grinding aid is on the order of 50 to 300 g, preferably 80 to 160 g, per square meter of coated abrasive product.

THE DRAWING

The invention may be more understandable by reference to the drawing wherein:

FIG. 1 schematically shows a method of printing abrasive granules onto a binder layer carried by a flexible backing, thus providing preferred abrasive sheeting of the invention;

Figure 1:
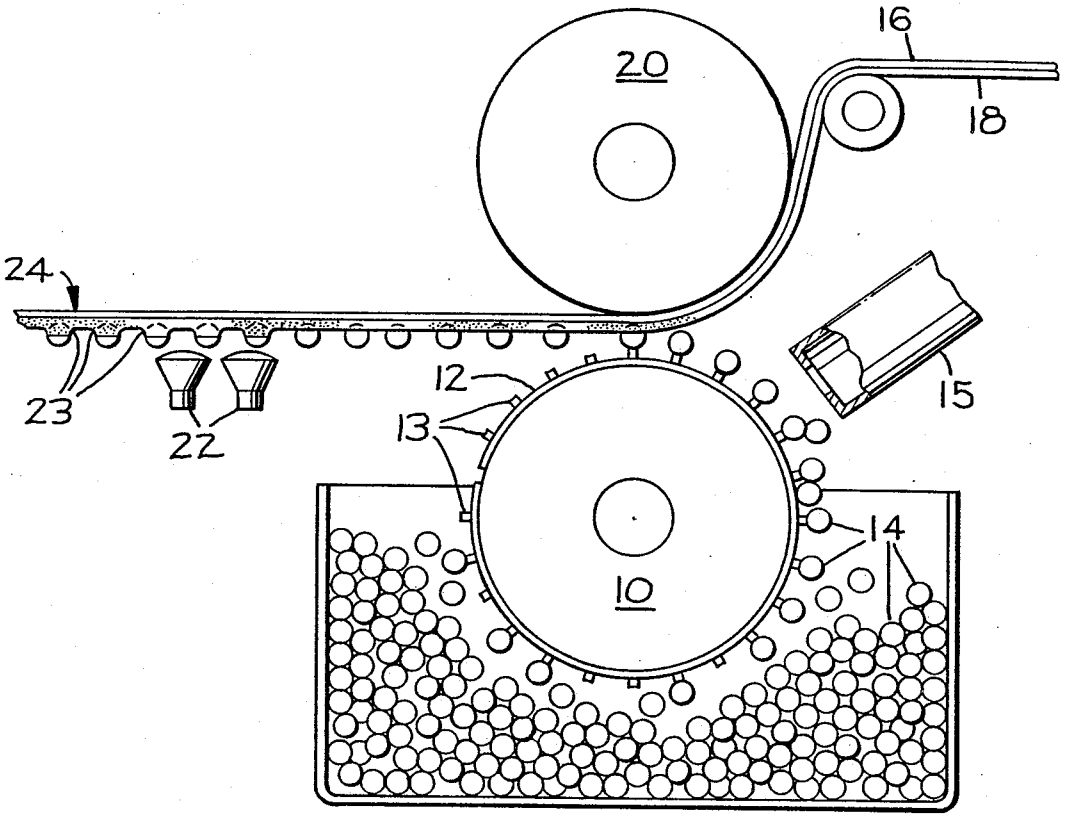
Figure 2:
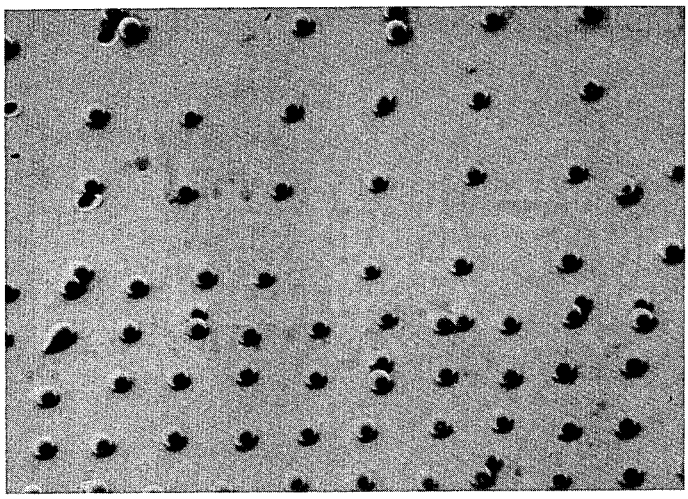
FIG. 2 is an electronmicrograph showing abrasive granules having been attracted to a tackified binder layer using apparatus illustrated in FIG. 1.

In FIG. 1, attached to a rotatable, heated metal cylinder 10 is a printing plate 12, the outer surface of which has been developed to leave roughly circular rubber dots 13. The cylinder is rotated through a fluidized bed of spherical abrasive granules 14, each of uniform diameter somewhat larger than the diameter of the rubber dots. After removing excess granules by suction at 15, substantially one abrasive granule 14 adheres to each of the rubber dots 13. Moving at the same speed as the surface of the cylinder 10 is a flexible backing 16 carrying a heat-activatable binder layer 18 which is pressed against the printing plate 12 by a heated nip roll 20. Heat from the cylinder 10 and rubber-covered nip roll 20 tackify the binder layer 18 to permit the attracted granules 14 to be adhered superficially to the binder layer 18 in spaced rows extending in the X and Y directions as seen in FIG. 2. In the upper left corner of FIG. 2, a few abrasive granules have fallen out, leaving small craters in the binder layer. The abrasive granules have been deposited in the lower part of FIG. 2 at twice the density of the upper part. At most positions, only one abrasive granule has been deposited, but at a few dots, there are two granules side by side.

Figure 3:
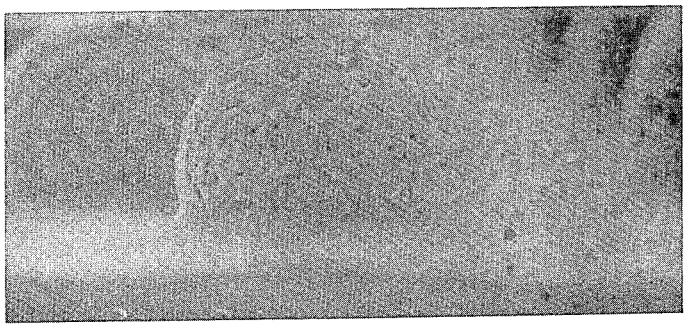
FIG. 3 is an electronmicrograph showing a fragment of abrasive sheeting of the invention made by heating the intermediate product of FIG. 2 to form a binder meniscus at each granule.

Referring again to FIG. 1, the granule-bearing backing 16 is passed across a bank of infrared lamps 22 by which the binder is heated to wet the surfaces of the abrasive granules, thus causing the binder layer to flow and form a meniscus 23 around the base of each granule as shown in the electronmicrograph of FIG. 3. This causes the abrasive granule to become strongly bonded to the flexible backing 16.

Figure 4:
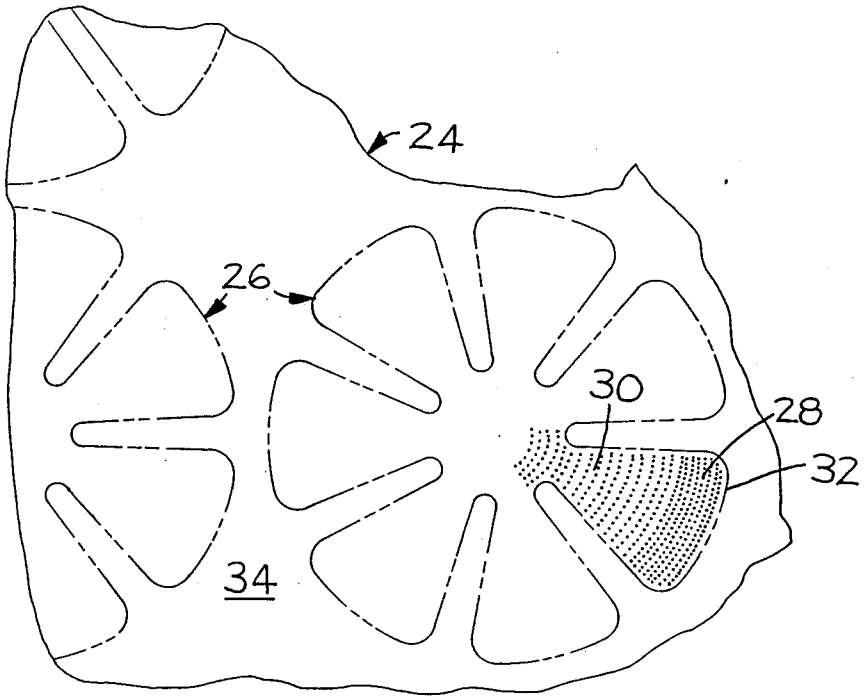
FIG. 4 schematically shows a fragment of an abrasive sheeting of the invention after it has been cut to form daisy pads.

The resulting abrasive sheeting 24 of the invention contains abrasive granules 14 individually positioned to permit the sheeting to be die-cut into daisy pads 26 as shown in FIG. 4. The abrasive granules have been positioned in concentric rows such that their density in areas 28 adjacent the outer edges of each petal is twice the density at the central areas 30 of the daisy pad. The abrasive sheeting from which the daisy pads 26 were cut was left free from abrasive granules adjacent the phantom line 32 at the peripheries of the petals along which the sheeting 24 is to be die-cut so that the die does not contact any abrasive granules. By leaving the area 34 between the daisy pads free from abrasive granules, no granules have been wasted.

In the following examples, all parts are given by weight.

EXAMPLE 1

Used to make abrasive sheeting of this example were:

(1) a negative-acting "Toray Waterless Plate" which had been exposed to a half-tone screen to produce roughly circular dots, each about 63 μm in diameter and arranged in rows extending parallel to both the lengthwise and widthwise edges of the plate, 20 rows per inch (7.9 per cm) in both directions;

(2) spherical abrasive granules, each 80 μm in diameter and made of 77 parts $Al_2O_3$ grains having a mean particle size of 4 μm in 23 parts of a matrix based on phenol-formaldehyde resin;

(3) a long roll of biaxially oriented poly(ethyleneterephthalate) polyester film 0.05 mm in thickness bearing a 0.05 mm binder layer of ethylene/acrylic acid copolymer.

The dot-containing plate was mounted on the metal cylinder 10 of the apparatus shown in FIG. 1, and spherical abrasive granules 14 were fluidized by a mechanical vibrator and became attached to the silicone dots 13. Excess granules were removed by suction at 15. The binder layer 18 was heated by the rubber-covered nip roll 20 to about 70° C. to become tacky so that the abrasive granules transferred to it, with a force of 79 N applied to the nip roll per cm of width. Additional heating by infrared lamps 22 caused the binder to form a meniscus around the base of each of the granules.

The exposed face of the polyester film backing of the resulting abrasive sheeting was laminated with a double-coated pressure-sensitive adhesive tape and this composite was die-cut into daisy pads 7.6 cm in diameter and similar in shape to the daisy pads 26 of FIG. 4 except having six petals. The pads were used as a second fining pad in the polishing of lenses formed of polycarbonate of the type commercially available from PPG under the trade designation CR39. A "Coburn" #506 cylinder machine was used at a load of 20 pounds (89 N) with a water flood on the high speed spindle setting. The test was conducted using two types of lapping tools, a 6.25/8.25 dioptral and a 2.12 dioptral. In both cases the amount of lens removed after two minutes was measured. The results are in Table I.

EXAMPLES 2–6

Abrasive sheetings of Examples 2–6 were made as in Example 1 except having different spacings of their rows in both directions as indicated in Table I. Also in Table I are results from using a "Control" daisy pad made with the same spherical abrasive granules coated from slurry in a manner used for current commercial production and having about 870 granules/cm$^2$. This granule density had been selected based upon extensive experimentation for general purpose use and was intermediate the granule densities of the abrasive sheetings of Examples 3 and 4.

TABLE I

| Ex. | Rows per inch | Rows per cm | mm of lens removed in 2 mins 2.12 d. lens | 6.25/8.25 d. lens |
|---|---|---|---|---|
| 1 | 20 | 7.9 | 0.001 | 0.000 |
| 2 | 40 | 15.7 | 0.091 | 0.058 |
| 3 | 65 | 25.6 | 0.025 | 0.078 |
| 4 | 85 | 33.5 | 0.026 | 0.124 |
| 5 | 150 | 59.0 | 0.012 | 0.032 |
| 6 | 200 | 78.7 | 0.009 | 0.025 |
| Control | | | 0.026 | 0.056 |

EXAMPLE 7

A negative-acting "Toray Waterless Plate" was exposed to produce 63 μm silicone rubber dots in rows extending in the X and Y directions at a density of 65 rows per inch (25.6 rows/cm). The plate was covered with the spherical abrasive granules of Example 1, and excess granules were then removed by turning the plate over and tapping it. Examination of the plate showed that there was at least one granule at each of the silicone dots. Against those granules was laid the binder layer of the polyester film backing of Example 1, and the composite was put through the nip of a heated two-roll laminator at about 73° C. while a force of 79 N was applied to the nip roll per cm of width. The composite was then placed in an oven at 112° C. for 10 minutes to cause the binder to form a meniscus around the base of each granule, resulting in abrasive sheeting of the invention.

EXAMPLES 8–11

A round-dot litho contact screen was exposed to form a pattern of spots, each 61 μm in diameter and equally spaced in rows extending in the X and Y directions. The number of rows of spots per unit distance within an inner circle 6.0 cm in diameter differed from the number of rows between that circle and an outer circle 15.24 cm in diameter. In other words, the spot population changed at the junction of the two circles as it does in FIG. 2. Several different combinations of populations were prepared in this manner as shown in Table II.

A negative-acting "Toray Waterless Plate" was exposed using each contact screen and developed in the usual manner. The developed plate was mounted on a metal cylinder and employed in the same way as in Example 1 to transfer spherical abrasive granules 83 μm in diameter from a fluidized bed to create 6-petal daisy pads, the centers of which coincided with the centers of the circles. The daisy pads were tested as in Example 1 with results in Table II in comparison to the same "Control".

TABLE II

| Ex. | Inner Circle Rows/cm | Outer Circle Rows/cm | mm of lens removed 212 lens | 625/825 lens |
|---|---|---|---|---|
| 8 | 19.7 | 33.5 | 0.034 | 0.040 |
| 9 | 25.6 | 19.7 | 0.108 | 0.086 |
| 10 | 25.6 | 33.5 | 0.058 | 0.102 |
| 11 | 25.6 | 39.4 | 0.070 | 0.103 |
| Control | | | 0.025 | 0.056 |

EXAMPLE 12

A round-dot litho contact screen was exposed to form an opaque spiral pattern using the standard formula $X = k\phi$ and $X = k\phi + 0.317$ mm, starting from a circle 2.1 cm in diameter and extending to a circle 15.2 cm in diameter. This produced opaque and transparent spiral areas of equal size between the two circles. Then using the developed contact screen as a mask, a laser was used to expose a negative-acting "Toray Waterless Plate" through the transparent areas of the mask to produce a pattern of dots 63 μm in diameter equally spaced in rows extending in the X and Y directions. There were 100 rows of silicone dots per inch (39.4 dots/cm) within a spiral pattern on the developed plate.

The developed plate was used as in Example 7 (except using abrasive granules 83 μm in diameter) to provide abrasive sheeting of the invention which was cut into a disc on which was centered the spiral pattern of abrasive granules in spaced rows.

EXAMPLE 13

Abrasive sheeting was prepared as in Example 7 except as follows:

(a) the abrasive granules were $Al_2O_3$ grains of irregular shape which had been screened to pass 100 mesh (150 μm openings) and retained on 120 mesh (125 μm openings);

(b) there were 65 rows/inch (25.6 rows/cm) of silicone dots;

(c) the abrasive sheeting, after being removed from the oven, was overcoated with a size coat of phenol-formaldehyde resin which after curing in an oven had a dry weight of 80 g/m$^2$.

The backing of this abrasive sheeting was laminated with a double-coated pressure-sensitive adhesive tape and then die-cut to 3-inch (7.5 cm) discs. Each disc was adhered by its pressure-sensitive adhesive to a "Coburn" No. 507 cylinder machine using the following settings: spindle stroke set at 7, spindle speed 100%, cross stroke 0, and a load of 30 pounds (133 N). The workpiece was a 1018 mild steel ring 4.45 cm I.D. and 5.4 cm O.D. The ring was abraded in an operation normally called flat lapping after being mounted on a bracket that fixed its axis perpendicular to the abrasive surface as the machine oscillated the abrasive surface in a circular motion. The test was run in one minute cycles at a rate endpoint of 0.3 g/min. The total cut and surface finish at endpoint are given in Table III in comparison to a "Control" made in the same way except that the abrasive granules were coated from slurry to provide a binder layer containing approximately the same mass of granules (i.e., about 0.40g).

TABLE III

| Example | Total Cut | $R_a$ (μm) | $R_t$ (μm) |
|---|---|---|---|
| 13 | 2.94 g | 0.30 | 2.87 |
| Control | 1.44 g | 0.45 | 3.45 |

$R_a$ = average surface roughness
$R_t$ = maximum peak-to-valley height

We claim:

1. Abrasive sheeting comprising a backing carrying a binder layer of substantially uniform thickness in which individually positioned abrasive granules are strongly bonded and lie substantially in a plane and at a predetermined lateral spacing between granules, said granules being of substantially equal size and passing a screen with 300 μm openings, and a portion of virtually every granule protruding from the surface of the binder layer.

2. Abrasive sheeting as defined in claim 1 wherein the binder layer forms a meniscus at each granule.

3. Abrasive sheeting as defined in claim 2 wherein substantially every granule is equiax and of substantially the same diameter, and each granule protrudes from the binder to substantially the same extent.

4. Abrasive sheeting as defined in claim 1 wherein single granules are aligned in uniformly spaced rows.

5. Abrasive sheeting as defined in claim 4, a great length of which is wound upon itself in roll form, said granules being in a predetermined pattern that repeats a large number of times over the length of the sheet.

6. Abrasive sheeting as defined in claim 5 wherein said predetermined pattern leaves areas of the binder layer free from abrasive granules in positions to be contacted by a tool for cutting the sheeting into articles of desired shapes, thus protecting the cutting tool from contacting abrasive granules.

7. Abrasive sheeting as defined in claim 1 wherein additional abrasive granules of substantially equal size different from the size of the first-mentioned abrasive granules are individually positioned in a second predetermined pattern and an uncoated portion of virtually every of said additional granules protrudes from the surface of the binder layer.

8. Abrasive sheeting as defined in claim 1 wherein said abrasive granules have irregular shapes, and the major axis of each granule lies substantially in a plane parallel to the backing.

9. Abrasive sheeting as defined in claim 1 and having a size coat covering the granules and the binder layer.

10. Abrasive sheeting as defined in claim 1 wherein a portion of virtually every granule is uncoated.

11. Abrasive sheeting comprising a backing carrying a binder layer in which individually positioned abrasive granules are bonded and lie substantially in a plane and at a predetermined lateral spacing between granules, said granules being of substantially equal size and passing a screen with 300 μm openings, a portion of virtually every granule protruding from the surface of the binder layer, and a size coat covering the granules and binder layer.

12. Abrasive sheeting defined in claim 11 wherein substantially every granule is equiax and of substantially the same diameter, and each granule protrudes from the binder layer to substantially the same extent.

13. Abrasive sheeting comprising a backing carrying a binder layer of substantially uniform thickness in which abrasive granules are strongly bonded and lie substantially in a plane, said granules being of substantially equal size to pass a screen with 300 μm openings, the granules having individual positions that are uniformly spaced laterally, there being only one granule at almost every position.

14. Abrasive sheeting as defined in claim 13 and having a size coat covering the granules and binder layer.

15. Method of making abrasive sheeting by the sequential steps of (1) attracting small abrasive granules only to dots laterally spaced in a predetermined pattern on a carrier, (2) while advancing a backing that carries a tacky binder layer in synchronism with said carrier, transferring the attracted granules into the binder layer in said pattern, and (3) rendering the binder nontacky.

16. Method as defined in claim 15, in step 2 of which the granules are pressed into the binder layer.

17. Method as defined in claim 16 wherein said carrier covers the cylindrical exterior of a rotating drum, and in step (1) the drum is rotated through a fluidized bed of said granules.

18. Method as defined in claim 15 wherein said dots are roughly circular, each having a diameter within the range of 30–90% of the mean dimension of the abrasive particles.

19. Method as defined in claim 15 and comprising subsequent to step (2) an additional step of causing the binder to flow to form a meniscus at each granule, thus strongly binding the granules to the backing.

20. Method of making abrasive sheeting comprising a backing carrying a binder layer in which abrasive granules of substantially uniform thicknesses are individually embedded in a predetermined pattern, said method comprising the steps of (1) coating one face of a metal foil with rubber and the other face with a photoresist, (2) exposing the photoresist to light in a predetermined pattern, (3) removing areas of the photoresist corresponding to said pattern, (4) removing areas of the metal foil, to expose the rubber in said pattern, (5) attracting abrasive granules to the exposed rubber areas, (6) while moving the tacky binder layer in synchronism with the exposed rubber areas, pressing the attracted granules into the binder layer in said pattern, and (7) rendering the binder nontacky, thereby producing abrasive sheeting, the individual abrasive granules of which lie in said pattern.

21. The method of claim 20 including the further step of removing any remaining areas of photoresist between steps (4) and (5).

* * * * *